US010761459B2

(12) United States Patent
Kishi

(10) Patent No.: US 10,761,459 B2
(45) Date of Patent: Sep. 1, 2020

(54) DRUM CARTRIDGE AND IMAGE FORMING APPARATUS

(71) Applicant: BROTHER KOGYO KABUSHIKI KAISHA, Nagoya-shi, Aichi-ken (JP)

(72) Inventor: Isao Kishi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/580,640

(22) Filed: Sep. 24, 2019

(65) Prior Publication Data

US 2020/0103790 A1 Apr. 2, 2020

(30) Foreign Application Priority Data

Sep. 28, 2018 (JP) ..... 2018-184209

(51) Int. Cl.
*G03G 15/16* (2006.01)
*G03G 15/00* (2006.01)

(52) U.S. Cl.
CPC ..... *G03G 15/1655* (2013.01); *G03G 15/80* (2013.01); *G03G 2215/025* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,403,741 | B2 * | 7/2008 | Yoshihara | H05K 7/20145 355/30 |
| 8,311,437 | B2 * | 11/2012 | Sato | G03G 21/1846 399/90 |
| 2007/0230999 | A1 | 10/2007 | Shimomura | |
| 2008/0019204 | A1 | 1/2008 | Jin | |
| 2008/0240774 | A1 | 10/2008 | Fukamachi et al. | |
| 2010/0135693 | A1 | 6/2010 | Okabe et al. | |
| 2013/0223869 | A1 | 8/2013 | Oda | |

FOREIGN PATENT DOCUMENTS

| | | | |
|---|---|---|---|
| JP | 2007-271895 | A | 10/2007 |
| JP | 2008-203566 | A | 9/2008 |
| JP | 2008-249801 | A | 10/2008 |
| JP | 2008-249802 | A | 10/2008 |
| JP | 2010-128336 | A | 6/2010 |
| JP | 2010-175619 | A | 8/2010 |
| JP | 2013-174723 | A | 9/2013 |

* cited by examiner

*Primary Examiner* — Victor Verbitsky
(74) *Attorney, Agent, or Firm* — Merchant & Gould P.C.

(57) ABSTRACT

A drum cartridge includes a first photosensitive drum, a frame, a main body connector, a first toner cartridge connector, a drum-cartridge circuit board, a harness, and a first harness. The harness is electrically connected between the main body connector and the drum-cartridge circuit board. The harness extends in the first direction. The first harness is electrically connected between the first toner cartridge connector and the drum-cartridge circuit board. The first harness extends in the second direction.

23 Claims, 7 Drawing Sheets

DRUM CARTRIDGE AND IMAGE FORMING APPARATUS

CROSS-REFERENCE TO RELATED APPLICATION

This application claims priority from Japanese Patent Application No. 2018-184209 filed on Sep. 28, 2018, the content of which is incorporated herein by reference in its entirety.

TECHNICAL FIELD

Aspects described herein relate to a drum cartridge and an image forming apparatus.

BACKGROUND

A known electrophotographic image forming apparatus such as a laser printer or an LED printer includes a drum cartridge. The drum cartridge includes a plurality of photosensitive drums. A plurality of toner cartridges are detachably attachable to such a drum cartridge. In a state where a toner cartridge is attached to the drum cartridge, a circumferential surface of a developing roller of the toner cartridge contacts a circumferential surface of a corresponding photosensitive drum of the drum cartridge.

SUMMARY

Some known toner cartridge may include a toner-cartridge memory. The toner-cartridge memory of the toner cartridge may store various information about the toner cartridge. An image forming apparatus may be configured such that a plurality of toner cartridges each including such a toner-cartridge memory are detachably attachable to a main body of the image forming apparatus. Nevertheless, an amount of information to be processed in the main body of the image forming apparatus may increase proportionally with increases in the number of toner cartridges to be attached to the main body of the image forming apparatus. That is, an amount of information to be transmitted between each of the toner cartridges and the main body of the image forming apparatus may increase proportionally with increases in the number of toner cartridges.

In some cases, in a state where the drum cartridge having the toner cartridge attached is attached to a main body of an image forming apparatus, the main body of the image forming apparatus may read information from the toner-cartridge memory of the toner cartridge via the drum cartridge. The drum cartridge may include a photosensitive drum, a frame, a main body connector, a toner cartridge connector, a drum-cartridge circuit board, a harness, and a first harness. The toner cartridge connector may be electrically connected to a toner-cartridge memory of the toner cartridge in a state where the toner cartridge is attached to the frame. The durum-cartridge circuit board may relay information between the toner-cartridge memory of the toner cartridge and the main body connector. The main body connector may be electrically connected to the main body of the image forming apparatus. The first harness may electrically connect between the toner cartridge connector and the drum-cartridge circuit board. The harness may electrically connect between the drum-cartridge circuit board and the main body connector.

The image forming apparatus may further include a main body and a duct for exhausting air from the main body. In such a case, the positions of the main body connector, the toner cartridge connector, the drum-cartridge circuit board, the harness, and the first harness of the drum cartridge may need to be considered. More specifically, for example, the main body connector may need to be positioned so as not to prevent exhaust performed by the duct. In addition, the toner cartridge connector, the drum-cartridge circuit board, the harness, and the first harness may need to be positioned such that the drum cartridge may be assembled readily.

Accordingly, some embodiments of the disclosure provide for a drum cartridge in which a main body connector, a toner cartridge connector, a drum-cartridge circuit board, a harness, and a first harness may be positioned so as not to prevent exhaust performed by a duct.

A first aspect of the disclosure provides a drum cartridge structure described below. The drum cartridge includes a first photosensitive drum, a frame, a main body connector, a first toner cartridge connector, a drum-cartridge circuit board, a harness, and a first harness. The first photosensitive drum is rotatable about a drum axis extending in a first direction. The frame includes a first side plate, a second side plate, and a first connecting plate. The first side plate is positioned at one side of the first photosensitive drum in the first direction. The second side plate is positioned at other side of the first photosensitive drum in the first direction. The first connecting plate connects between the first side plate and the second side plate. The first connecting plate includes one end and other end in the first direction. The one end of the first connecting plate connects to one end of the first side plate in a second direction intersecting the first direction. The other end of the first connecting plate connects to one end of the second side plate in the second direction. The main body connector is positioned at the other end of the first connecting plate. The first toner cartridge connector is positioned at an inner surface of the first side plate. The first connector is spaced apart from the main body connector in the second direction. The drum-cartridge circuit board is electrically connected between the main body connector and the first toner cartridge connector. The drum-cartridge circuit board is positioned at the first connecting plate. The harness electrically connects between the main body connector and the drum-cartridge circuit board. The harness extends in the first direction. The first harness electrically connects between the first toner cartridge connector and the drum-cartridge circuit board. The first harness extends in the second direction.

According to the one or more aspects of the disclosure, the main body connector, the first toner cartridge connector, the drum-cartridge circuit board, the harness, and the first harness may be positioned in the drum cartridge so as not to prevent exhaust performed by the duct of the image forming apparatus.

DETAILED DESCRIPTION

An illustrative embodiment will be described with reference to the accompanying drawings.

In the following description, a direction in which a drum axis of each photosensitive drum extends may be defined as a first direction. A direction in which the photosensitive drums are arranged one behind another may be defined as a second direction. The first direction and the second direction may intersect each other (preferably at right angles). A direction intersecting both of the first and second directions (preferably at right angles) may be defined as a third direction. In each units or components, an end positioned on one side of the unit or the component in each direction may be referred to as one end, and an opposite end positioned on the other side of the unit or the component in each direction may be referred to as the other end.

1. Illustrative Embodiment

1-1. Configuration of Image Forming Apparatus

Figure 1:
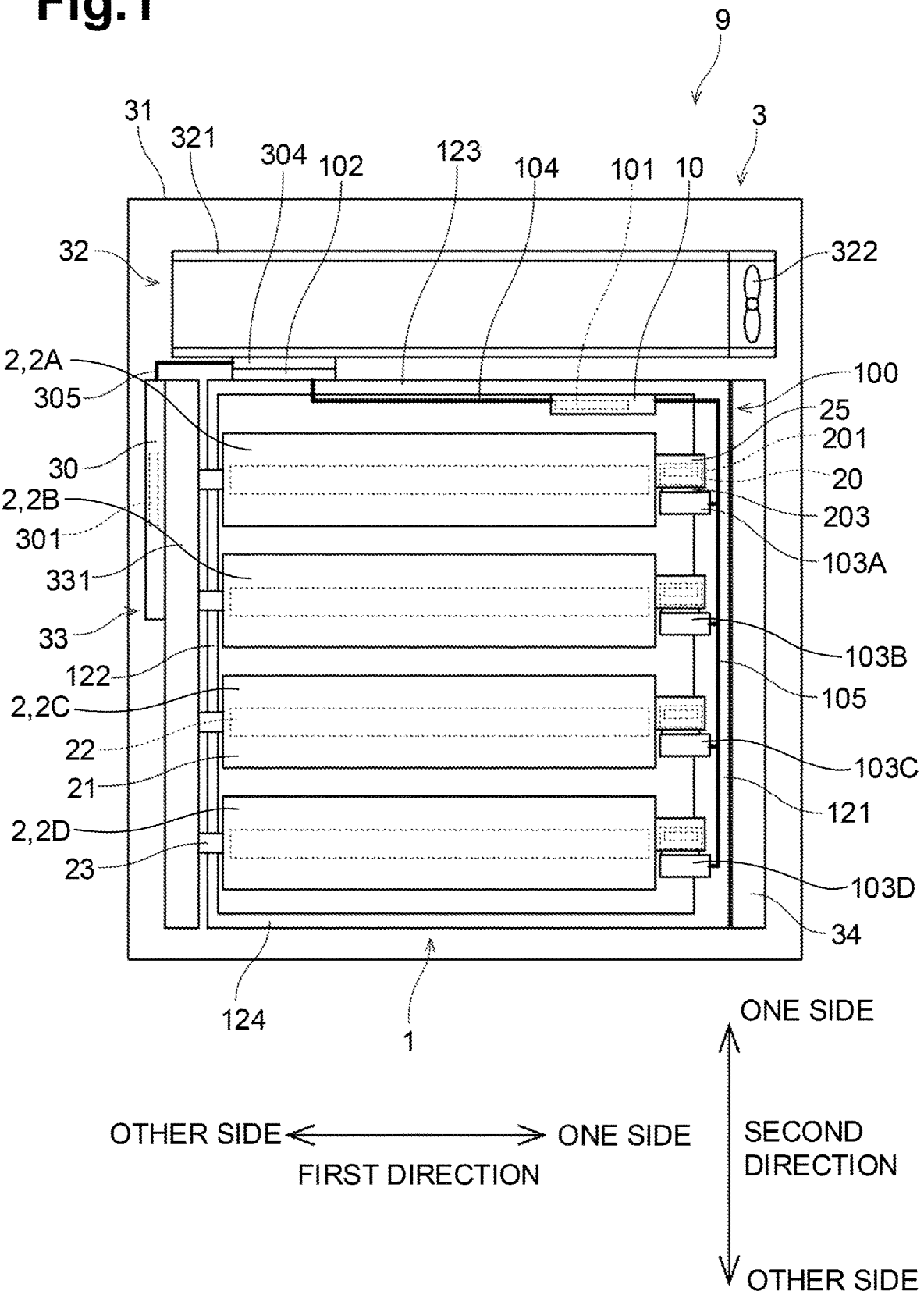
FIG. 1 is a schematic diagram of an image forming apparatus in an illustrative embodiment according to one or more aspects of the disclosure.

FIG. 1 illustrates an image forming apparatus 9 as viewed from one side in a third direction. The image forming apparatus 9 according to the illustrative embodiment may be an electrophotographic printer. Examples of the image forming apparatus 9 include laser printers and LED printers. As illustrated in FIG. 1, the image forming apparatus 9 includes a drum cartridge 1, a plurality of toner cartridges 2, and a main body 3.

The toner cartridges 2 are attachable to the drum cartridge 1 individually. The drum cartridge 1 having the toner cartridges 2 attached thereto is attachable to a casing 31 of the main body 3.

In the illustrative embodiment, the toner cartridges 2 include a first toner cartridge 2A, a second toner cartridge 2B, a third toner cartridge 2C, and a fourth toner cartridge 2D. The toner cartridges 2 store toners (developer) of respective different colors (e.g., cyan, magenta, yellow, and black). The image forming apparatus 9 is configured to form an image onto a surface of a sheet using toner supplied from the toner cartridges 2. In the illustrative embodiment, the number of toner cartridges 2 to be attached to the drum cartridge 1 may be four. Nevertheless, the number of toner cartridges 2 to be attached to the drum cartridge 1 might not be limited to the specific example. In other embodiments, for example, the number of toner cartridges 2 to be attached to the drum cartridge 1 may be at least one, or may be less than or more than four.

The drum cartridge 1 includes a circuit unit 100. The circuit unit 100 includes a drum-cartridge circuit board 10, a drum-cartridge memory 101, a main body connector 102, a plurality of toner cartridge connectors 103, a harness 104, and harnesses 105.

The drum-cartridge memory 101 may be a readable and rewritable storage medium. The main body connector 102 is configured to be electrically connected to the main body 3 in a state where the drum cartridge 1 is attached to the main body 3. Each of the toner cartridge connectors 103 is configured to be electrically connected to a toner-cartridge memory 201 of a corresponding one of the toner cartridges 2 in a state where the toner cartridges 2 are attached to the drum cartridge 1. In the illustrative embodiment, the drum cartridge 1 allows four toner cartridges 2 to be attached thereto, and thus the circuit unit 100 includes four toner cartridge connectors 103. The toner cartridge connectors 103 include a first toner cartridge connector 103A, a second toner cartridge connector 103B, a third toner cartridge connector 103C, and a fourth toner cartridge connector 103D. The first toner cartridge connector 103A is configured to be electrically connected to a first toner-cartridge memory 201A of the first toner cartridge 2A in a state where the first toner cartridge 2A is attached to the frame 12. The second toner cartridge connector 103B is configured to be electrically connected to a second toner-cartridge memory 201B of the second toner cartridge 2B in a state where the second toner cartridge 2B is attached to the frame 12. The third toner cartridge connector 103C is configured to be electrically connected to a third toner-cartridge memory 201C of the third toner cartridge 2C in a state where the third toner cartridge 2C is attached to the frame 12. The fourth toner cartridge connector 103D is configured to be electrically connected to the fourth toner-cartridge memory 201D of the fourth toner cartridge 2D in a state where the fourth toner cartridge 2D is attached to the frame 12.

More specifically, for example, the harness 104 electrically connects between the drum-cartridge circuit board 10 and the main body connector 102. Each of the harnesses 105 electrically connects between the drum-cartridge circuit board 10 and a corresponding one of the toner cartridge connectors 103. In the illustrative embodiment, the harnesses 105 include a first harness 105A, a second harness 105B, a third harness 105C, and a fourth harness 105D. The first harness 105A electrically connects between the first toner cartridge connector 103A and the drum-cartridge circuit board 10. The second harness 105B electrically connects between the second toner cartridge connector 103B and the drum-cartridge circuit board 10. The third harness 105C electrically connects between the third toner cartridge connector 103C and the drum-cartridge circuit board 10. The fourth harness 105D electrically connects between the fourth toner cartridge connector 103D and the drum-cartridge circuit board 10. Thus, the first harness 105A, the drum-cartridge circuit board 10, and the harness 104 electrically connect between the first toner cartridge connector 103A and the main body connector 102. The second harness 105B, the drum-cartridge circuit board 10, and the harness 104 electrically connect between the second toner cartridge connector 103B and the main body connector 102. The third harness 105C, the drum-cartridge circuit board 10, and the harness 104 connect electrically between the third toner cartridge connector 103C and the main body connector 102. The fourth harness 105D, the drum-cartridge circuit board 10, and the harness 104 connect electrically between the fourth toner cartridge connector 103D and the main body connector 102. The first harness 105A and the second harness 105B are covered by the first cover 106A. The third harness 105C and the fourth harness 105D are covered by the second cover 106B.

All of the toner cartridges 2 may have the same configuration. Therefore, one of the toner cartridges 2 will be described in detail and a description for the others will be omitted. A toner cartridge 2 includes a toner-cartridge circuit board 20, the toner-cartridge memory 201, and a connector 203. The toner-cartridge memory 201 may be a readable and rewritable storage medium. The connector 203 of the toner cartridge 2 is configured to be electrically connected to a corresponding one of the toner cartridge connectors 103 of the drum cartridge 1 in a state where the toner cartridge 2 is attached to the drum cartridge 1.

In the illustrative embodiment, the first toner cartridge connector 103A is configured to be electrically connected to a first toner-cartridge memory 201A of the first toner cartridge 2A. The second toner cartridge connector 103B is configured to be electrically connected to a second toner-cartridge memory 201B of the second toner cartridge 2B. The third toner cartridge connector 103C is configured to be electrically connected to a third toner-cartridge memory 201C of the third toner cartridge 2C. The fourth toner cartridge connector 103D is configured to be electrically connected to the fourth toner-cartridge memory 201D of the fourth toner cartridge 2D.

Such a configuration may thus enable the toner-cartridge circuit board 20 of each of the toner cartridges 2 and the drum-cartridge circuit board 10 to be electrically connected to each other in a state where the toner cartridges 2 are attached to the drum cartridge 1. In a state where the drum cartridge 1 having the toner cartridges 2 attached is attached to the casing 31 of the image forming apparatus 9, the drum-cartridge circuit board 10 is electrically connected to a controller 30 of the main body 3. Thus, the toner-cartridge circuit board 20 of each of the toner cartridges 2 is electrically connected to the controller 30 via the drum-cartridge circuit board 10. That is, the drum-cartridge circuit board 10 may be a relay board that relays information between the toner-cartridge memory 201 of the toner cartridges 2 and the controller 30 of the main body 3 in a state where the drum cartridge 1 is attached to the casing 31 of the main body 3.

1-2. Configuration of Drum Cartridge

As illustrated in FIGS. 1 to 4, the drum cartridge 1 includes a plurality of photosensitive drums 11, a frame 12, and the circuit unit 100. In the illustrative embodiment, the photosensitive drums 11 are equal in number (e.g., four) to the toner cartridges 2 allowed to be attached to the drum cartridge 1.

The drum cartridge 1 is attachable to and detachable from the main body of the image forming apparatus 9 in the second direction. That is, the second direction may correspond to an attaching/detaching direction in which the drum cartridge 1 is attached to and detached from the casing 31 of the image forming apparatus 9.

Each photosensitive drum 11 is configured to transfer toner supplied from a corresponding toner cartridge 2 onto a sheet. The photosensitive drums 11 are spaced apart from each other in the second direction. Each photosensitive drum 11 has a cylindrical shape extending in the first direction. Each photosensitive drum 11 has a circumferential surface. The circumferential surface of each photosensitive drum 11 is covered by photosensitive material. Each of the photosensitive drums 11 includes a drum axis 110 extending in the first direction. Each of the photosensitive drums 11 is rotatable about the drum axis 110. In the illustrative embodiment, the photosensitive drums 11 include a first photosensitive drum 11A, a second photosensitive drum 11B, a third photosensitive drum 11C, and a fourth photosensitive drum 11D.

Figure 2:
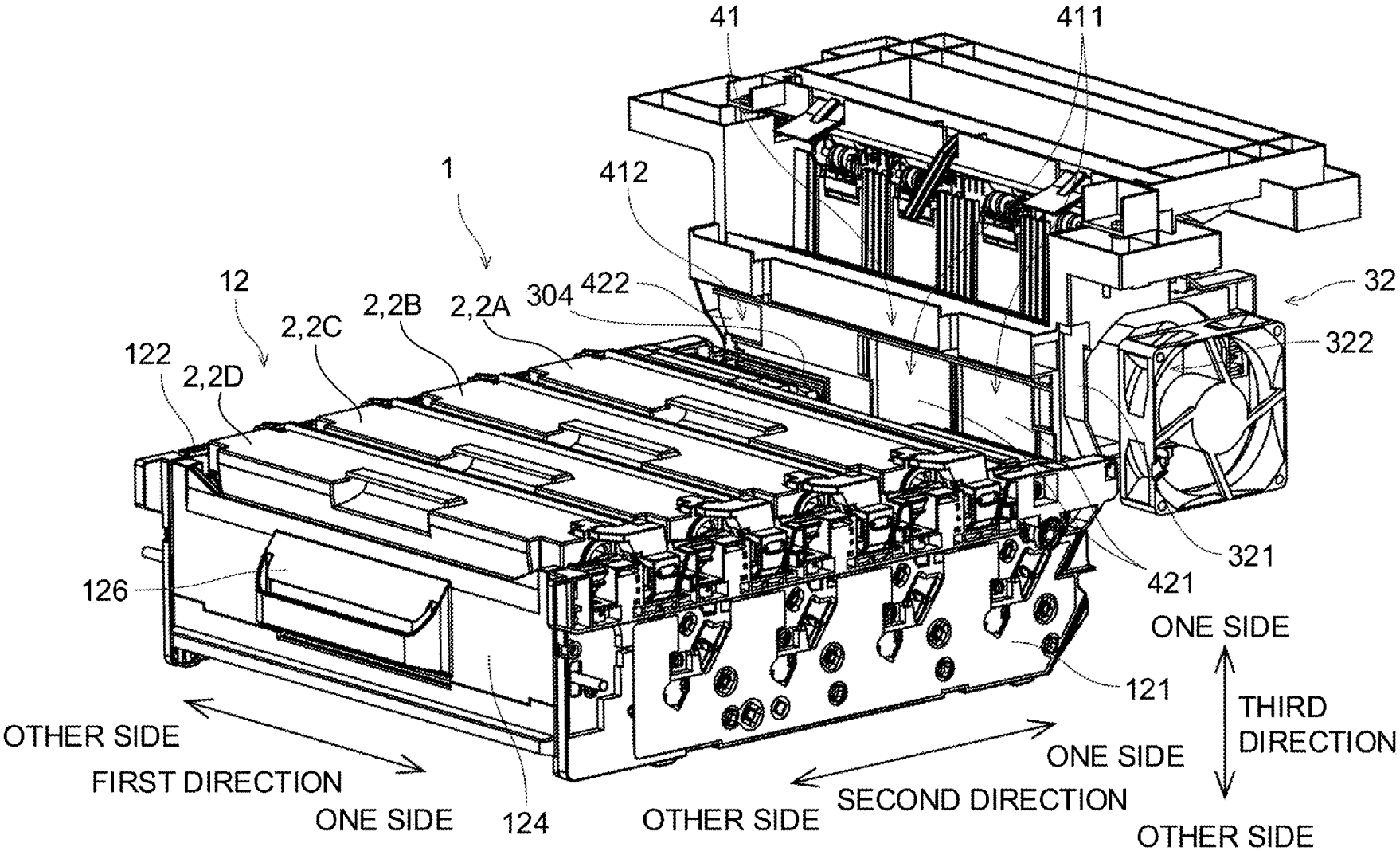
FIG. 2 is a perspective view of a drum cartridge and a ventilator in the illustrative embodiment according to one or more aspects of the disclosure.
Figure 3:
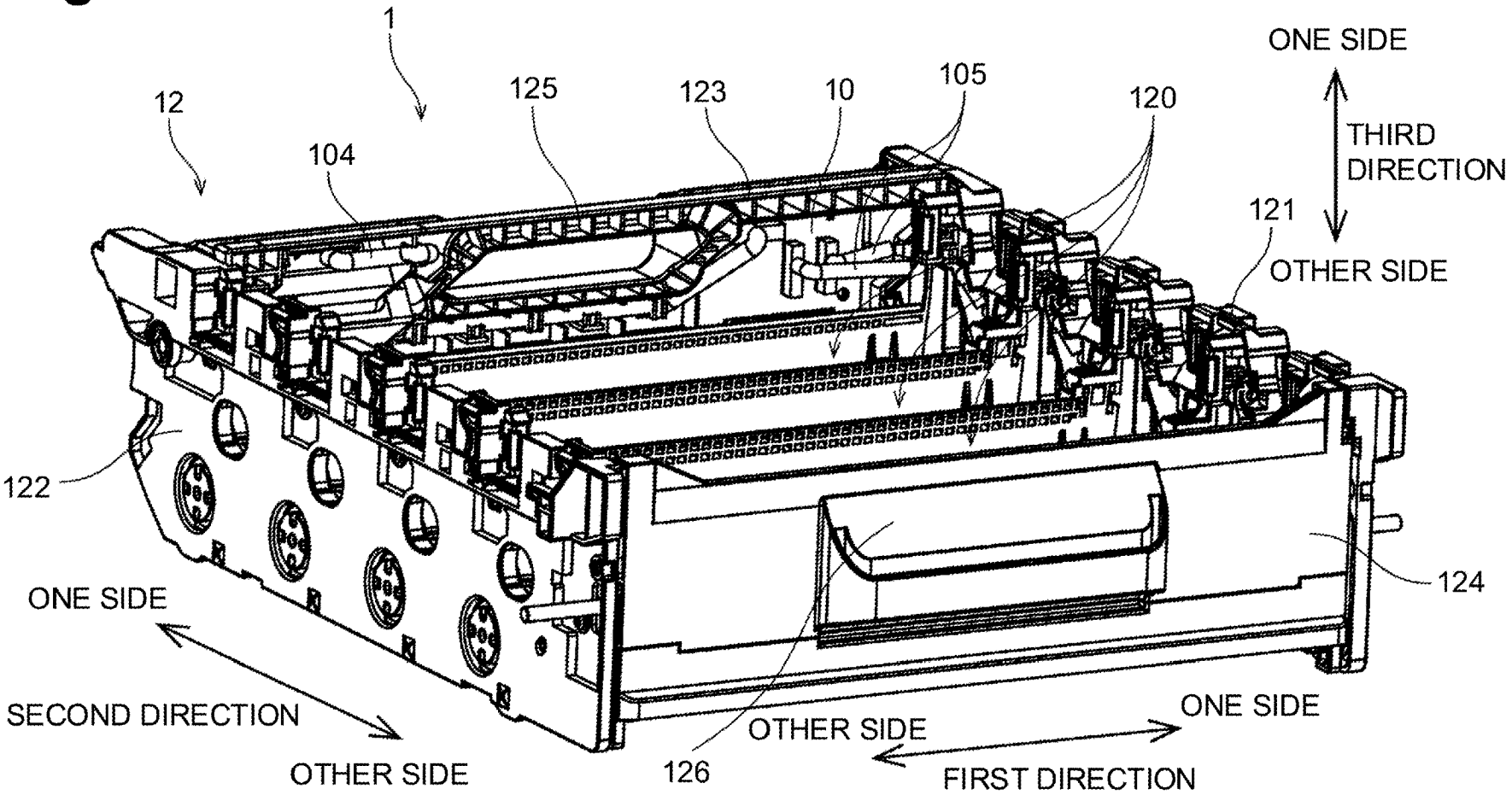
FIG. 3 is a perspective view of the drum cartridge in the illustrative embodiment according to one or more aspects of the disclosure.
Figure 4:
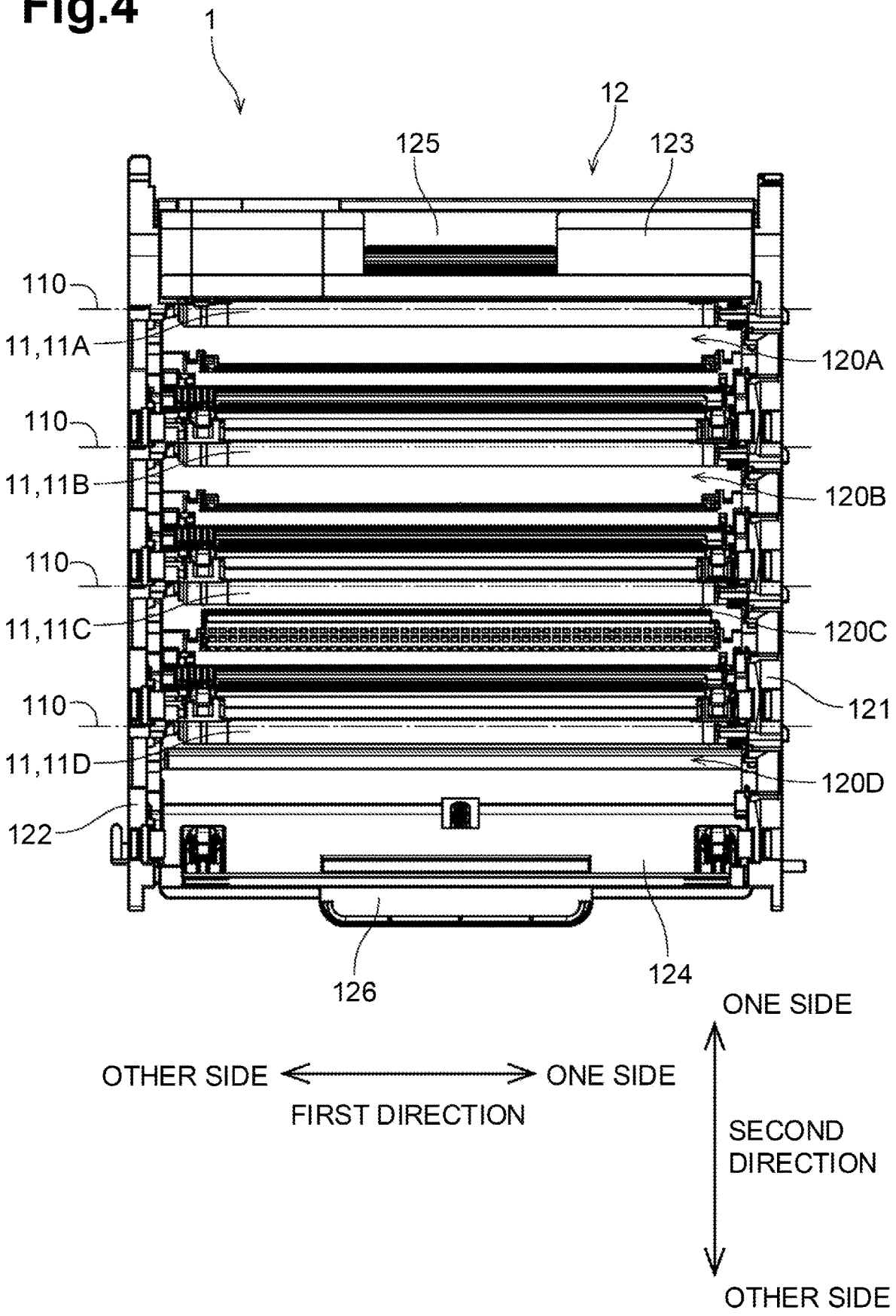
FIG. 4 is a plan view of the drum cartridge in the illustrative embodiment according to one or more aspects of the disclosure.
Figure 5:
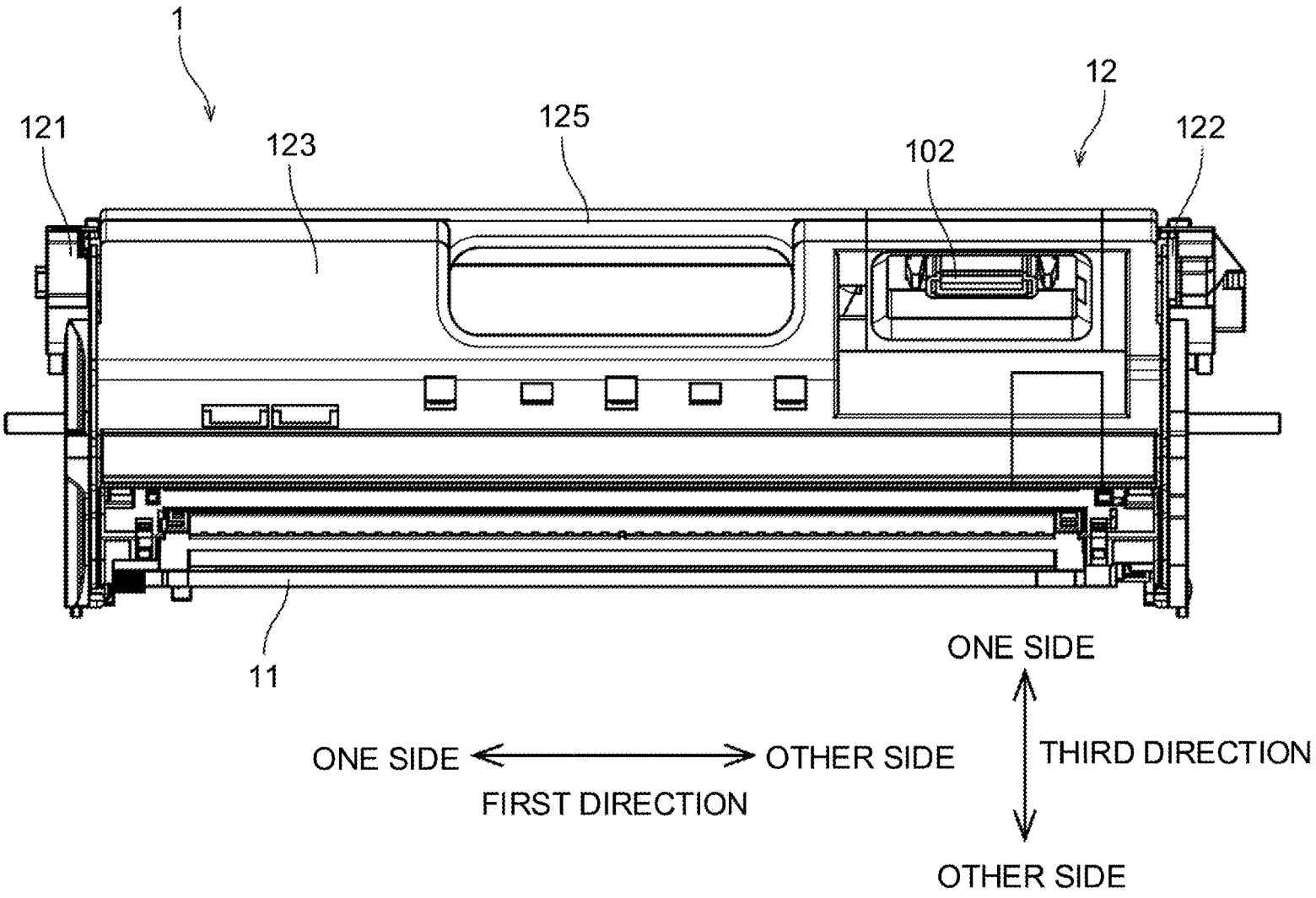
FIG. 5 is a plan view of the drum cartridge in the illustrative embodiment according to one or more aspects of the disclosure.

As illustrated in FIGS. 2, 3, and 4, the frame 12 holds the photosensitive drums 11. The frame 12 includes a first side plate 121, a second side plate 122, a first connecting plate 123, and a second connecting plate 124.

The first side plate 121 is positioned at one end portions of the photosensitive drums 11 in the first direction. The second side plate 122 is positioned at the other end portions of the photosensitive drums 11 in the first direction. The second side plate 122 is spaced apart from the first side plate 121 in the first direction.

The first connecting plate 123 connects between one end portion of the first side plate 121 and one end portion of the second side plate 122 in the second direction. The second connecting plate 124 connects between the other end portion of the first side plate 121 and the other end portion of the second side plate 122 in the second direction. The second connecting plate 124 is spaced apart from the first connecting plate 123 in the second direction.

The frame 12 includes a plurality of toner cartridge holders 120. The toner cartridge holders 120 are spaced apart from each other in the second direction. The toner holders 120 include a first toner holder 120A, a second toner holder 120B, a third toner holder 120C, and a fourth toner holder 120D. The toner cartridges 2 may be attached to the respective toner cartridge holders 120. The first toner cartridge 2A may be attached to the first toner cartridge holder 120A. The second toner cartridge 2B may be attached to the second toner cartridge holder 120B. The third toner cartridge 2C may be attached to the third toner cartridge holder 120C. The fourth toner cartridge 2D may be attached to the fourth toner cartridge holder 120D. That is, the frame 12 is allowed to receive a plural number of toner cartridges 2. In a state where a toner cartridge 2 is attached to a corresponding toner cartridge holder 120, a circumferential surface of a corresponding photosensitive drum 11 contacts a circumferential surface of a developing roller 22 of the toner cartridge 2.

In a state where the toner cartridges 2 are attached to the frame 12, the toner cartridges 2 are positioned between an inner surface of the first side plate 121 and an inner surface of the second side plate 122 in the first direction. In a state where the toner cartridges 2 are attached to the frame 12, the toner cartridges 2 are positioned between an inner surface of the first connecting plate 123 and an inner surface of the second connecting plate 124 while being spaced apart from each other in the second direction.

As described above, the drum cartridge 1 includes the circuit unit 100. The circuit unit 100 includes the drum-cartridge circuit board 10, the drum-cartridge memory 101, the main body connector 102, the plurality of toner cartridge connectors 103, the harness 104, and the harnesses 105.

Figure 6:
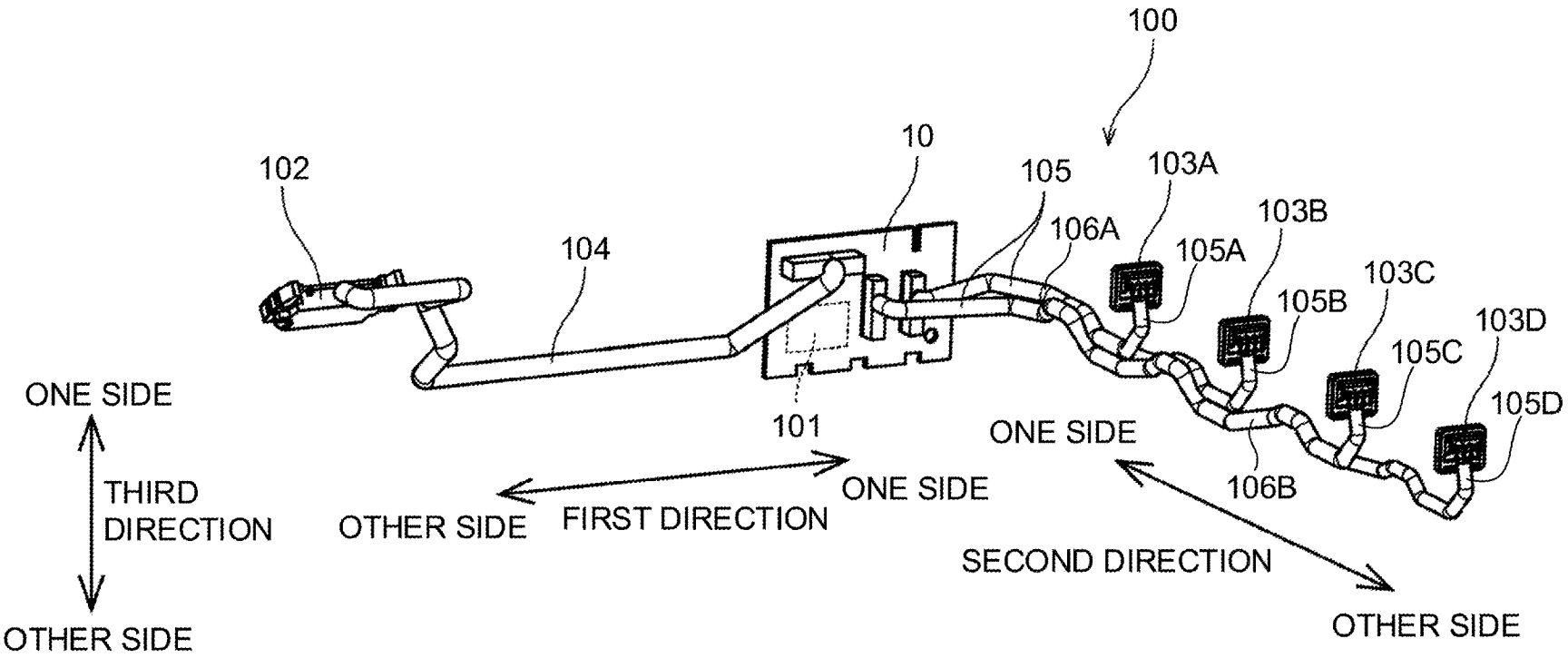
FIG. 6 is a perspective view of a circuit unit in the illustrative embodiment according to one or more aspects of the disclosure.

The drum-cartridge circuit board 10 is electrically connected to the main body connector 102 and each of the toner cartridge connectors 103. The drum-cartridge circuit board 10 is positioned at the inner surface of the one end portion of the first connecting plate 123 in the first direction. The drum-cartridge circuit board 10 may be a relay board that electrically relays information between the main body connector 102 and each of the toner cartridge connectors 103. As illustrated in FIGS. 1 and 6, the drum-cartridge circuit board 10 and the main body connector 102 are electrically connected to each other via the harness 104. The drum-cartridge circuit board 10 and each of the toner cartridge connectors 103 are electrically connected to each other via the harnesses 105. The harness 104 and the harnesses 105 may be wire harnesses including a plurality of wires.

The drum-cartridge memory 101 is positioned on the drum-cartridge circuit board 10. The drum-cartridge memory 101 is configured to store various information about the drum cartridge 1. The drum-cartridge memory 101 may store, for example, at least one of information for identifying the drum cartridge 1 (hereinafter, referred to as "identification information") and information indicating features of the drum cartridge 1 (hereinafter, referred to as "feature information"). The identification information may include, for example, at least one of a manufacturing serial number and an identification code certifying that the drum cartridge 1 is genuine. The feature information may include, for example, at least one of conforming models, specifications of the drum cartridge 1, a remaining life of each photosensitive drum 11, charging characteristic of each photosensitive drum 11, information, with respect to each photosensitive drum 11, as to whether the photosensitive drum 11 is yet to be used, the number of rotations of each photosensitive drum 11, the total charging time of each photosensitive drum 11, the number of sheets that have been printed, and an error record. The drum-cartridge memory 101 might not necessarily be positioned on the drum-cartridge circuit board 10. In other embodiments, for example, the drum-cartridge memory 101 may be positioned at the frame 12.

The drum-cartridge memory 101 includes a first storage area and a second storage area. The first storage area may be an unrewritable area for storing information that should not be rewritten. The second storage area may be a rewritable area for storing information that may be rewritten or updated. The first storage area may store, for example, at least one of the manufacturing serial number, the identification code, the conforming models, the specification, the remaining life of each photosensitive drum 11, and the charging characteristic of each photosensitive drum 11. The second storage area may store, for example, usage condition of the drum cartridge 1. The usage condition of the drum cartridge 1 may be, for example, at least one of the information as to whether the drum cartridge 1 is yet to be used, the number of rotations of each photosensitive drum 11, the total charging time of each photosensitive drum 11, the number of sheets that have been printed, and the error record.

The drum-cartridge memory 101 may also store information about the toner cartridges 2. For example, the drum-cartridge memory 101 may store identification information about each of the toner cartridges 2 attached to the frame 12 of the drum cartridge 1. The identification information may be read from the toner-cartridge memory 201 of each of the toner cartridges 2 and written into the drum-cartridge memory 101 of the drum-cartridge circuit board 10. It may be thus determined that, based on the information stored in the drum-cartridge memory 101, with respect to each of the toner cartridges 2 currently attached to the frame 12 of the drum cartridge 1, whether the toner cartridge 2 has been used before or not. Nevertheless, the drum-cartridge memory 101 might not necessarily be configured to store information about the toner cartridges 2.

The drum-cartridge memory 101 may store a usage history of each of the toner cartridges 2 attached to frame 12 of the drum cartridge 1. The usage history of each of the toner cartridges 2 may be, for example, at least one of the number of rotations of the developing roller 22, an amount of toner used, and an error record of the toner cartridge 2. Storing such a usage history of each of the toner cartridges 2 in the drum-cartridge memory 101 may enable the controller 30 to analyze an error occurring in each of the toner cartridges 2 by referring to the drum-cartridge memory 101 but not referring to the toner-cartridge memory 201 of each of the toner cartridges 2. Nevertheless, the drum-cartridge memory 101 might not necessarily be configured to store such a usage history of each of the toner cartridges 2 attached to the frame 12 of the drum cartridge 1.

In a state where the drum cartridge 1 is attached to the main body 3 of the image forming apparatus 9, the main body connector 102 contacts a connector 304 of the main body 3 to be electrically connected to the connector 304. The first connecting plate 123 includes one end and the other end in the first direction. The one end of the first connecting plate 123 connects the one end portion of the first side plate 121 in the second direction. The other end of the first connecting plate 123 connects the one end portion of the second side plate 122 in the second direction. The main body connector 102 is positioned at an outer surface of the other end portion of the first connecting plate 123 in the first direction.

Each of the toner cartridge connectors 103 is configured to, in a state where the toner cartridge 2 is attached to the frame 12 of the drum cartridge 1, be electrically connected to the toner connector 203 of a corresponding toner cartridge 2. The toner cartridge connectors 103 is provided for each of the toner cartridge holder 120. In each of the toner cartridge holders 120, the toner cartridge connectors 103 is positioned at one end portion of the toner cartridge holder 120 in the first direction. The toner cartridge connectors 103 are fixed to, for example, the surface of the frame 12. Nevertheless, in other embodiments, for example, the toner cartridge connectors 103 may be supported by the frame 12 so as to be slightly movable relative to the frame 12.

The first connecting plate 123 of the frame 12 includes a first handle 125. The second connecting plate 124 of the frame 12 includes a second handle 126. The first handle 125 and the second handle 126 each enable a user to hold the drum cartridge 1. The first handle 125 has an opening penetrating the first connecting plate 123 in the third direction. The second handle 126 has an opening penetrating the second connecting plate 124 in the second direction or a recessed portion being recessed toward one end of the second connecting plate 124 in the third direction from other end of the second connecting plate 124 in the third direction.

In the illustrative embodiment, the first handle 125 is positioned between the main body connector 102 and the drum-cartridge circuit board 10 in the first direction. That is, the first handle 125 does not overlap the main body connector 102 and the drum-cartridge circuit board 10 in the third direction. Such a configuration may thus provide a large space for receiving each of the main body connector 102 and the drum-cartridge circuit board 10 in the third direction.

1-3. Configuration of Toner Cartridges

The configuration of each of the toner cartridges 2 attached to the frame 12 of the drum cartridge 1 will be described with reference to the first direction, the second direction, and the third direction. All of the toner cartridges 2 may have the same configuration, and therefore, the description will be provided with respect to one of the toner cartridges 2.

As illustrated in FIGS. 1 and 2, the toner cartridge 2 includes a casing 21, a developing roller 22, a plurality of gears, a coupling 23, a gear cover, the toner-cartridge circuit board 20, the toner-cartridge memory 201, and the connector 203.

The casing 21 includes a toner storage chamber for storing toner. The casing 21 has an opening.

The developing roller 22 is rotatable about a developing axis extending in the first direction. The developing roller 22 is positioned at the opening of the casing 21. That is, the developing roller 22 is positioned at the other end of the casing 21 in the third direction. In a state where the toner cartridge 2 is attached to the frame 12 of the drum cartridge 1, a circumferential surface of the developing roller 22 contacts a circumferential surface of a corresponding photosensitive drum 11.

Toner is supplied from the toner storage chamber to the circumferential surface of the photosensitive drum 11 via the developing roller 22. Toner held by the circumferential surface of the developing roller 22 then moves to the circumferential surface of the photosensitive drum 11 in accordance with an electrostatic latent image formed on the circumferential surface of the photosensitive drum 11. The electrostatic latent image is thus visualized on the circumferential surface of the photosensitive drum 11.

The gears, the coupling 23, and the gear cover are positioned at the surface of the other end of the casing 21 in the first direction. The gear cover is positioned at the outer surface of the other end of the casing 21 in the first direction. For example, the gear cover may be fixed to the casing 21 using screws. At least one or more of the gears are positioned between the surface of the one end of the casing 21 and the gear cover in the first direction. The coupling 23 is not covered by the gear cover. In a state where the drum cartridge 1 having the toner cartridges 2 is attached to the image forming apparatus 9, drive shafts of the image forming apparatus 9 are connected to the respective couplings 23 of the toner cartridges 2. Rotation of each drive shaft is transmitted to a corresponding one of the developing rollers 22 via a corresponding coupling 23 and gears.

The toner-cartridge circuit board 20, the toner-cartridge memory 201, and the connector 203 are held by the holder 25. The holders 25 are positioned at the one end portion of the first side plate 1 in the first direction. The holder 25 be preferably movable in the second direction relative to the casing 21 and the gear cover.

The toner-cartridge circuit board 20, the toner-cartridge memory 201, the connector 203, and the holder 25 are positioned at the outer surface of one end portion of the casing 21 in the first direction. For example, the toner-cartridge circuit boards 20 of the first, second, third, and fourth toner cartridges 2A, 2B, 2C, and 2D may be referred to as the first, second, third, and fourth toner-cartridge circuit boards 20A, 20B, 20C, and 20D, respectively. The toner-cartridge memories 201 of the first, second, third, and fourth toner cartridges 2A, 2B, 2C, and 2D may be referred to as the first, second, third, and fourth memories 201A, 201B, 201C, and 201D, respectively. The connectors 203 of the first, second, third, and fourth toner cartridges 2A, 2B, 2C, and 2D may be referred to as the first, second, third, and fourth connectors 203A, 203B, 203C, and 203D, respectively.

The toner cartridge 2 includes the toner-cartridge memory 201 that may be a storage medium. The toner-cartridge memory 201 is positioned on the toner-cartridge circuit board 20. The toner-cartridge memory 201 is configured to store various information about the toner cartridge 2. The toner-cartridge memory 201 may store, for example, at least one of information for identifying the toner cartridge 2 (hereinafter, referred to as "identification information") and information indicating features of the toner cartridge 2 (hereinafter, referred to as "feature information"). The identification information may include, for example, at least one of a manufacturing serial number and an identification code certifying that the toner cartridge 2 is genuine. The feature information may include, for example, at least one of conforming models, specifications of the toner cartridge 2, a toner capacity of the toner cartridge 2, a remaining life of the developing roller 22, information as to whether the toner cartridge 2 is yet to be used, the number of rotations of the developing roller 22, the number of sheets that have been printed, and the error record. The toner-cartridge memory 201 might not necessarily be positioned on the toner-cartridge circuit board 20. In other embodiments, for example, the toner-cartridge memory 201 may be positioned on the casing 21.

1-4. Main Body

Figure 7:
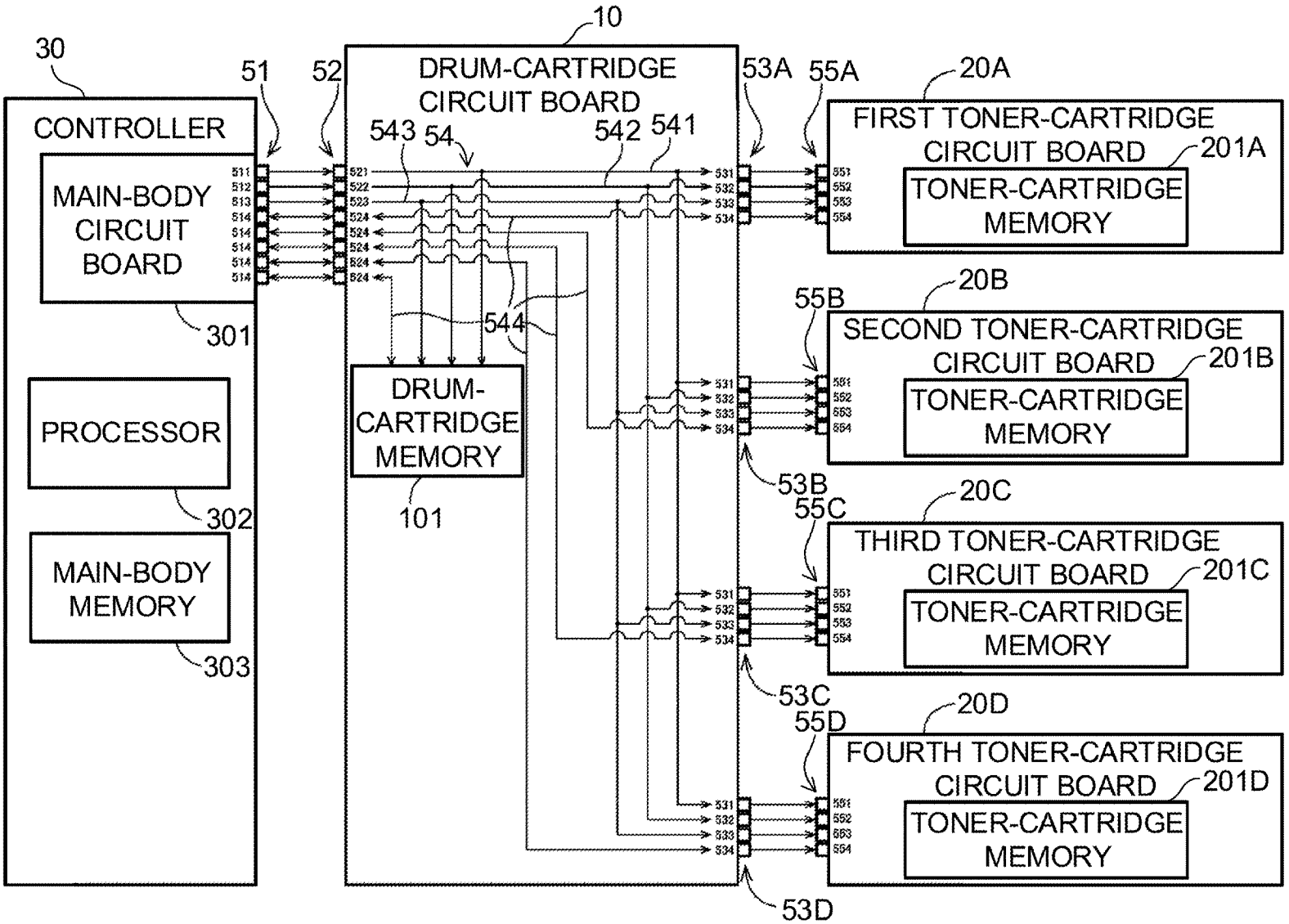
FIG. 7 is a block diagram of an electrical connection between the controller, a drum-cartridge circuit board, and toner-cartridge circuit boards in the illustrative embodiment according to one or more aspects of the disclosure.

Referring to FIGS. 1, 2, and 7, the main body 3 of the image forming apparatus 9 will be described. The main body 3 includes the controller 30, the casing 31, a ventilator 32, a board placement portion 33, and a voltage supply 34. The controller 30 and the ventilator 32 are positioned in the casing 31.

As illustrated in FIG. 7, the controller 30 includes a main-body circuit board 301, a processor 302 such as a CPU, and a main-body memory 303. The controller 30 is configured to execute various processing in the image forming apparatus 9 in response to operation of the processor 302 in accordance with the program.

The casing 31 accommodates various units, including the ventilator 32, the board placement portion 33, and the voltage supply 34, of the image forming apparatus 9. The drum cartridge 1 may be attached to the casing 31.

The ventilator 32 generates airflow in the casing 31. The ventilator 32 is positioned to the one side of the drum cartridge 1 in the second direction in a state where the drum cartridge 1 is attached to the casing 31. The ventilator 32 includes a duct 321 and a fan 322.

The duct 321 may have a tubular shape extending in the first direction. The duct 321 has one end and the other end in the second direction. In a state where the drum cartridge 1 is attached to the casing 31, the other end of the duct 321 in the second direction faces the first connecting plate 123 of the drum cartridge 1 in the second direction. The first connecting plate 123 is positioned at the one end portion of the drum cartridge 1 in the second direction.

The fan 322 is positioned at one end of the duct 321 in the first direction. The fan 322 is configured to discharge air from the duct 321 to the outside of the casing 31. The main body connector 102 is positioned at other end of the duct 321 in the first direction.

The duct 321 has a plurality of intake openings 41 defined in its other end in the second direction. The intake openings 41 may be through holes. The intake openings 41 allow air to pass therethrough to flow into the duct 321 from the casing 31. In the illustrative embodiment, the duct 321 has, for example, three intake openings 41. More specifically, for example, the intake openings 41 include two first intake openings 411 and one second intake opening 412. The first intake openings 411 are positioned closer to the one end of the duct 321 in the first direction than to the other end of the duct 321 in the first direction. The second intake opening 412 is positioned closer to the other end portion of the duct 321 in the first direction than to the one end of the duct 321 in the first direction.

The duct 321 further includes two first filters 421 and one second filter 422. The first filters 421 cover the respective first intake openings 411. The second filter 422 covers the second intake opening 412. The first filers 421 and the second filter 422 may be ozone elimination filters.

As the fan 322 rotates, the fan 322 draws out air in the duct 321 out of the casing 31. The exhaust of air from the duct 321 may thus cause drawing of air into the duct 321 through the intake openings 411 and 412. When air passes the intake openings 411 and 412, the first filters 421 and the second filters 422 eliminate ozone included in the drawn air. The air from which ozone has been eliminated then flows into the duct 321. As described above, the first filters 421 and the second filter 422 may eliminate ozone generated in the drum cartridge 1 before the fan 322 draws out the drawn air from the duct 321 to the outside of the casing 31.

The controller 30 and a drive-force input unit 331 are positioned in the board placement portion 33. In a state where the drum cartridge 1 is attached to the casing 31, the board placement portion 33 is positioned at the other side of the second side plate 122 in the first direction and faces the outer surface of the second side plate 122 in the first direction. The drive-force input unit 331 includes the drive shafts that are configured to, in a state where the drum cartridge 1 is attached to the casing 31, be connected to the respective couplings 23 of the toner cartridges 2. The drive shafts are configured to rotate to transmit drive force to the respective couplings 23 in accordance with an instruction provided by the controller 30.

The main body 3 includes the connector 304 and wiring 305. The connector 304 is configured to be electrically connected to the main body connector 102 of the drum cartridge 1 in a state where the drum cartridge 1 is attached to the main body 3. The wiring 305 electrically connects between the connector 304 and the main-body circuit board 301.

As illustrated in FIG. 2, the connector 304 is arranged the second intake opening 412 and the second filter 422 in the third direction. Such a configuration may thus allow the second intake opening 412 and the second filter 422 to be arranged the main body connector 102 of the drum cartridge 1 in the third direction in a state where the drum cartridge 1 is attached to the casing 31.

With this configuration, the second intake opening 412 has a dimension less than a dimension of the first intake openings 411 in the third direction. The second filter 422 thus has a dimension less than a dimension of the first filters 421 in the third direction. The second intake opening 412 has an opening smaller than each of the first intake openings 411. The second filter 422 is thus smaller in size than each of the first filters 421.

The force to draw air in the duct 321 may increase with being closer to the fan 322. Thus, the opening of each of the first intake openings 411 may preferably be greater than the opening of the second intake opening 412. Such a configuration may enable air to be drawn into the duct 321 efficiently. Thus, in the illustrative embodiment, the connector 304 is closer to the second intake opening 412 than to the first intake openings 411. With this arrangement, each of the first intake openings 411 may have a relatively large opening area.

The drum-cartridge circuit board 10 is positioned such that, in a state where the drum cartridge 1 is attached to the casing 31, the drum-cartridge circuit board 10 is positioned at the same position in the second direction as the first intake opening 411. Thus, air surrounding the drum-cartridge circuit board 10 may be drawn into the duct 321 through the intake openings 411 efficiently, thereby cooling down the drum-cartridge circuit board 10.

The voltage supply 34 is configured to supply a bias voltage to the photosensitive drums 11 of the drum cartridge 1 and the developing rollers 22 of the toner cartridges 2. In a state where the drum cartridge 1 is attached to the casing 31, the voltage supply 34 is positioned to the one end portion of the first side plate 121 in the first direction and faces the outer surface of the first side plate 121 in the first direction.

1-5. Position of Circuit Unit of Drum Cartridge

Referring to FIGS. 1 to 6, the position of the circuit unit 100 of the drum cartridge 1 will be described.

As illustrated in FIG. 1, the connector 304 is electrically connected to the controller 30 in the main body 3. The board placement portion 33 is positioned at the other end portion of the casing 31 in the first direction. The connector 304 of the main body 3 may thus preferably be positioned at the other end portion of the frame 12 in the first direction. Thus, the connector 304 is positioned at a corresponding position in the main body 3 such that the connector 204 may face the other end portion of the first connecting plate 123 of the drum cartridge 1.

The connector 304 to be electrically connected to the main body connector 102 is positioned at the outer surface of the other end portion of the first connecting plate 123 in the first direction. The drum-cartridge circuit board 10 is positioned at the inner surface of the one end portion of the first connecting plate 123 in the first direction. Thus, the harness 104 that connects between the drum-cartridge circuit board 10 and the main body connector 102 extends along the inner surface of the first connecting plate 123. That is, the harness 104 extends in the first direction.

The toner cartridge connectors 103 to be electrically connected to the respective connectors 203 of the toner cartridges 2 are positioned at the first side plate 121. Thus, the harnesses 105 that connect between the respective toner cartridge connectors 103 and the drum-cartridge circuit board 10 extend along the inner surface of the first side plate 121. That is, the harnesses 105 extends in the second direction. For example, the first harness 105A that connect between the first toner cartridge connector 103A and the drum-cartridge circuit board 10 extend along the inner surface of the first side plate 121. That is, the first harness 105A extends in the second direction. The second harness 105B that connect between the second toner cartridge connector 103B and the drum-cartridge circuit board 10 extend along the inner surface of the first side plate 121. That is, the second harness 105B extends in the second direction. The third harness 105C that connect between the third toner cartridge connector 103C and the drum-cartridge circuit board 10 extend along the inner surface of the first side plate 121. That is, the third harness 105C extends in the second direction. The fourth harness 105D that connect between the fourth toner cartridge connector 103D and the drum-cartridge circuit board 10 extend along the inner surface of the first side plate 121. That is, the fourth harness 105D extends in the second direction.

As described above, the main body connector 102 and the toner cartridge connectors 103 are spaced apart from each other in the first direction and in the second direction. The drum-cartridge circuit board 10 that may be a relay board is positioned at the one end portion of the first connecting plate 123 in the first direction. Such a configuration may thus enable the harness 104 that connects between the main body connector 102 and the drum-cartridge circuit board 10 and the harnesses 105 that connect between each of the toner cartridge connectors 103 and the drum-cartridge circuit board 10 to be routed without being bent greatly.

1-6. Electrical Connection

Referring to FIGS. 1 and 7, electrical connection between the controller 30, the drum-cartridge circuit board 10, and the toner-cartridge circuit boards 20 will be described. As illustrated in FIG. 7, the main-body circuit board 301 of the controller 30 includes terminals 51, each of which is connected to the drum-cartridge circuit board 10 indirectly. The drum-cartridge circuit board 10 includes first terminals 52, second terminals 53 and relay lines 54. The toner-cartridge circuit board 20 of each of the toner cartridges 2 includes terminals 55. The terminals 51, the first terminals 52, the second terminals 53, and the terminals 55 may be bare conductors.

In a state where the drum cartridge 1 is attached to the main body 3 of the image forming apparatus 9, the terminals 51 of the main-body circuit board 301 are electrically connected to the respective first terminals 52 of the drum-cartridge circuit board 10 via the wiring 305 and the connector 304 of the main body 3 and the harness 104. The terminals 51 of the main-body circuit board 301 include a voltage terminal 511, a ground terminal 512, a clock terminal 513, and a plurality of signal terminals 514. As illustrated in FIG. 7, in the illustrative embodiment, for example, the plurality of signal terminals 514 include five signal terminals 514. That is, the main-body circuit board 301 includes eight terminals 51.

The first terminals 52 of the drum cartridge 1 include a voltage terminal 521, a ground terminal 522, a clock terminal 523, and a plurality of signal terminals 524. As illustrated in FIG. 7, in the illustrative embodiment, for example, the plurality of signal terminals 524 include five signal terminals 524. That is, the drum-cartridge circuit board 10 includes eight first terminals 52.

In a state where the drum cartridge 2 is attached to the main body 3 of the image forming apparatus 1, the second terminals 53 of the drum-cartridge circuit board 10 are electrically connected to the respective terminals 55 of the toner-cartridge circuit boards 20 via the harnesses 105 and the toner cartridge connectors 103 of the drum cartridge 1 and the connectors 203 of the respective toner cartridges 2. The second terminals 53 of the drum cartridge 2 include a plurality of voltage terminals 531, a plurality of ground terminals 532, a plurality of clock terminals 533, and a plurality of signal terminals 534. As illustrated in FIG. 7, in the illustrative embodiment, for example, the second terminals 53 includes four each of the voltage terminals 531, the ground terminals 532, the clock terminals 533, and the signal terminals 534. That is, the drum-cartridge circuit board 10 of the drum cartridge 2 includes 16 second terminals 53.

The toner cartridges 2 include a first toner cartridge 2A, a second toner cartridge 2B, a third toner cartridge 2C, and a fourth toner cartridge 2D. The toner-cartridge circuit boards 20 of the first, second, third, and fourth toner cartridges 2A, 2B, 2C, and 2D may be referred to as the first, second, third, and fourth toner-cartridge circuit boards 20A, 20B, 20C, and 20D, respectively.

The second terminals 53 are divided into four groups that include a first group 53A including four of the second terminals 53, a second group 53B including another four of the second terminals 53, a third group 53C including another four of the second terminals 53, and a fourth group 53D including the remaining four of the second terminals 53.

In a state where the first toner cartridge 2A is attached to the frame 12 of the drum cartridge 1, the second terminals 53 of the first group 53A are electrically connected to the respective terminals 55 of the toner-cartridge circuit board 20A of the first toner cartridge 2A. In a state where the second toner cartridge 2B is attached to the frame 12 of the drum cartridge 1, the second terminals 53 of the second group 53B are electrically connected to the respective terminals 55 of the toner-cartridge circuit board 20B of the second toner cartridge 2B. In a state where the third toner cartridge 2C is attached to the frame 12 of the drum cartridge 1, the second terminals 53 of the third group 53C are electrically connected to the respective terminals 55 of the toner-cartridge circuit board 20C of the third toner cartridge 2C. In a state where the fourth toner cartridge 2D is attached to the frame 12 of the drum cartridge 1, the second terminals 53 of the fourth group 53D are electrically connected to the respective terminals 55 of the toner-cartridge circuit board 20D of the fourth toner cartridge 2C.

The second terminals 53 of each of the groups 53A, 53B, 53C, and 53D include one each of the voltage terminals 531, the ground terminals 532, the clock terminals 533, and the signal terminals 534.

The relay lines 54 include a voltage line 541, a ground line 542, a clock line 543, and a plurality of signal lines 544. As illustrated in FIG. 7, in the illustrative embodiment, for example, the plurality of signal lines 544 include five signal lines 544. That is, the drum-cartridge circuit board 10 includes eight relay lines 54.

The voltage line 541 has one end and the other end. The one end of the voltage line 541 is electrically connected to the voltage terminal 521 of the first terminals 52. The other end of the voltage line 541 may be a five-pronged end and is electrically connected to the voltage terminal 531 of the first group 53A, the voltage terminal 531 of the second group 53B, the voltage terminal 531 of the third group 53C, the voltage terminal 531 of the fourth group 53D correspondingly.

The ground line 542 has one end and the other end. The one end of the ground line 542 is electrically connected to the ground terminal 522 of the first terminals 52. The other end of the ground line 542 may be a five-pronged end and is electrically connected to the ground terminal 532 of the first group 53A, the ground terminal 532 of the second group 53B, the ground terminal 532 of the third group 53C, the ground terminal 532 of the fourth group 53D correspondingly.

The clock line 543 has one end and the other end. The one end of the clock line 543 is electrically connected to the clock terminal 523 of the first terminals 52. The other end of the clock line 543 may be a five-pronged end and is electrically connected to the clock terminal 533 of the first group 53A, the clock terminal 533 of the second group 53B, the clock terminal 533 of the third group 53C, the voltage terminal 533 of the fourth group 53D correspondingly.

As illustrated in FIG. 7, in the illustrative embodiment, for example, the plurality of signal lines 544 include five signal lines 544. Each of the signal lines 544 has one end and the other end. The one end of each of the ground line 542 is electrically connected to a corresponding one of the ground signal 524 of the first terminals 52. The one end of each of four of the signal lines 544 is electrically connected to a corresponding one of the signal terminals 534 of the second terminals 53. The one end of the remaining one of the signal lines 544 is electrically connected to the drum-cartridge memory 101. That is, the four signal terminals 524 of the first terminals 52 are connected one to one to the four signal terminals 534 of the second terminals 53 via a corresponding one of the signal lines 544. The remaining one of the signal terminal 524 of the first terminals 52 is connected one to one to the drum-cartridge memory 101 via the remaining one of the signal line 544 of the relay lines 54.

The terminals 55 of each of the toner cartridge 2 include a voltage terminal 551, a ground terminal 552, a clock terminal 553, and a signal terminal 554. As illustrated in FIG. 7, in the illustrative embodiment, for example, the terminals 55 of each of the toner cartridge 2 include four terminals 55.

In a state where the drum cartridge 1 having the toner cartridges 2 is attached to the main body 3 of the image forming apparatus 9, the terminals 52 of the main-body circuit board 301 are electrically connected to the respective terminals 55 of the toner cartridges 2 via the wiring 305 and the connector 304 of the main body 3, the harness 104, the drum-cartridge circuit board 10, the harnesses 105, the toner cartridge connectors 103, of the drum cartridge 1, and the connectors 203 of the toner cartridges 2. Hereinafter, a description will be provided on an electrical signal status between the controller 30, the drum-cartridge circuit board 10, and the toner-cartridge circuit boards 20 in the above state.

In response to establishment of an electrical connection between the voltage terminal 511 of the controller 30 and the voltage terminal 521 of the drum-cartridge circuit board 10, a power voltage is supplied from the controller 30 to the drum-cartridge circuit board 10. The voltage terminal 521 is electrically connected to the voltage terminals 531 of the second terminals 53 and the drum-cartridge memory 101 via the voltage line 541. Further, each of the voltage terminals 531 of the second terminals 53 is electrically connected to the voltage terminal 551 of a corresponding toner cartridge 2. Such a connection may allow supply of the power voltage from the controller 30 to each of the toner-cartridge circuit boards 20 and the drum-cartridge memory 101 via the drum-cartridge circuit board 10. The common use of the voltage terminal 521 may thus reduce the number of first terminals 52 provided in the drum-cartridge circuit board 10.

In response to establishment of an electrical connection between the ground terminal 512 of the controller 30 and the ground terminal 522 of the drum-cartridge circuit board 10, a ground voltage is supplied from the controller 30 to the drum-cartridge circuit board 10. The ground terminal 522 is electrically connected to the ground terminals 532 of the second terminals 53 and the drum-cartridge memory 101 via the ground line 542. Further, each of the ground terminals 532 of the second terminals 53 is electrically connected to the ground terminal 552 of a corresponding toner cartridge 2. Such a connection may allow supply of the ground voltage from the controller 30 to each of the toner-cartridge circuit boards 20 and the drum-cartridge memory 101 via the drum-cartridge circuit board 10. The common use of the ground terminal 522 may thus reduce the number of first terminals 52 provided in the drum-cartridge circuit board 10.

In response to establishment of an electrical connection between the clock terminal 513 of the controller 30 and the clock terminal 523 of the drum-cartridge circuit board 10, a clock signal is periodically transmitted from the controller 30 to the drum-cartridge circuit board 10. The clock terminal 523 is electrically connected to the clock terminals 533 of the second terminals 53 and the drum-cartridge memory 101 via the clock line 543. Further, each of the clock terminals 533 of the second terminals 53 is electrically connected to the clock terminal 553 of a corresponding toner cartridge 2. Such a connection may allow transmission of the clock signal from the controller 30 to each of the toner-cartridge circuit boards 20 and the drum-cartridge memory 101 via the drum-cartridge circuit board 10. The common use of the clock terminal 523 may thus reduce the number of first terminals 52 provided in the drum-cartridge circuit board 10.

In response to establishment of an electrical connection between each of the signal terminals 514 of the controller 30 and a corresponding one of the signal terminals 524 of the drum-cartridge circuit board 10, signals indicating various information are allowed to be transmitted between the controller 30 and the drum-cartridge circuit board 10. In the illustrative embodiment, serial communication may be performed for transmitting information. The four signal terminals 524 of the first terminals 52 are connected one to one to the four signal terminals 534 of the second terminals 53 via a corresponding one of the signal lines 544. Further, each of the signal terminals 534 of the second terminals 53 is electrically connected to the signal terminal 554 of a corresponding toner cartridge 2. The remaining one of the signal terminal 524 of the first terminals 52 is electrically connected to the drum-cartridge memory 101 via the remaining signal line 544. Such a connection may allow transmission of the signals indicating various information between the controller 30, each of the toner-cartridge circuit boards 20, and the drum-cartridge memory 101 via the drum-cartridge circuit board 10.

In the illustrative embodiment, as described above, the drum-cartridge circuit board 10 is used as a relay board that relays signals between the controller 30 and the toner-cartridge circuit boards 20, thereby reducing the number of terminals as compared with a configuration in which the drum-cartridge circuit board 10 and the toner-cartridge circuit boards 20 are both directly connected to the controller 30.

While the disclosure has been described in detail with reference to the specific embodiment thereof, this is merely an example, and various changes, arrangements and modifications may be applied therein without departing from the spirit and scope of the disclosure.

What is claimed is:

1. A drum cartridge comprising:

a first photosensitive drum rotatable about a drum axis extending in a first direction;

a frame holding the photosensitive drum and including:

a first side plate positioned at one side of the first photosensitive drum in the first direction;

a second side plate positioned at the other side of the first photosensitive drum in the first direction; and a first connecting plate connecting between the first side plate and the second side plate, the first connecting plate including one end and other end in the first direction, the one end of the first connecting plate connecting to one end of the first side plate in a second direction intersecting the first direction, the other end of the first connecting plate connecting to one end of the second side plate in the second direction;

a main body connector positioned at the other end of the first connecting plate;

a first toner cartridge connector positioned at an inner surface of the first side plate, the first toner cartridge connector spaced apart from the main body connector in the second direction;

a drum-cartridge circuit board being electrically connected between the main body connector and the first toner cartridge connector, the drum-cartridge circuit board positioned at the first connecting plate;

a harness electrically connecting the main body connector and the drum-cartridge circuit board, the harness extending in the first direction; and a first harness electrically connecting the first connector and the drum-cartridge circuit board, the first harness extending in the second direction.

2. The drum cartridge according to claim 1, wherein the drum-cartridge circuit board is positioned at an inner surface of the one end of the first connecting plate.

3. The drum cartridge according to claim 1, wherein the main body connector is positioned at an outer surface of the other end of the first connecting plate.

4. The drum cartridge according to claim 1, wherein the frame is configured to receive a first toner cartridge, and wherein the first toner cartridge is positioned between the first side plate and the second side plate in the first direction in a state where the first toner cartridge is attached to the frame.

5. The drum cartridge according to claim 1, wherein the frame includes a second connecting plate connecting between the first side plate and the second side plate, the second connecting plate including one end and other end in the first direction, the one end of the second connecting plate connecting to other end of the first side plate in the second direction, the other end of the second connecting plate connecting to other end of the second side plate in the second direction, the second connecting plate spaced apart from the first connecting plate in the second direction.

6. The drum cartridge according to claim 5, wherein the frame is configured to receive a first toner cartridge, and wherein the first toner cartridge is positioned between the first connecting plate and the second connecting plate in the second direction in a state where the first toner cartridge is attached to the frame.

7. The drum cartridge according to claim 1, wherein the harness is positioned at an inner surface of the first connecting plate.

8. The drum cartridge according to claim 1, wherein the first harness is positioned at the inner surface of the first side plate.

9. The drum cartridge according to claim 1, wherein the first connecting plate includes a handle positioned between the connector and the drum-cartridge circuit board in the first direction.

10. The drum cartridge according to claim 9, wherein the handle has an opening penetrating the first connecting plate in the third direction.

11. The drum cartridge according to claim 1, wherein the drum-cartridge circuit board is configured to relay information stored a first toner-cartridge memory of a first toner cartridge attached to the frame to a controller of a main body in a state where the drum cartridge is attached to a casing of the main body.

12. The drum cartridge according to claim 11, further comprising:

a second toner cartridge connector positioned at the inner surface of the first side plate, the second connector spaced apart from the connector and the first toner cartridge connector in the second direction; and a second harness electrically connecting the second connector and the drum-cartridge circuit board, the second harness extending in the second direction.

13. The drum cartridge according to claim 6, wherein the frame is configured to receive a second toner cartridge, and wherein the drum-cartridge circuit board is configured to relay information stored in a second toner-cartridge memory of the second toner cartridge to the controller in a state where the drum cartridge is attached to the casing.

14. The drum cartridge according to claim 1, further comprising a drum-cartridge memory positioned on the drum-cartridge circuit board.

15. The drum cartridge according to claim 1, wherein terminals of the first toner cartridge connector contact terminals of a first toner-cartridge circuit board of the first toner cartridge in a state where the first toner cartridge is attached to the frame.

16. The drum cartridge according to claim 1, wherein the drum cartridge is attachable to the main body in the second direction.

17. An image forming apparatus comprising:

the drum cartridge according to claim 1, a main body including a controller and a casing, and a first toner cartridge includes a first toner-cartridge memory, wherein the drum-cartridge circuit board relays information stored in the first toner-cartridge memory of the first toner cartridge to the controller in a state where the drum cartridge is attached to the casing.

18. An image forming apparatus comprising:

the drum cartridge according to claim 1, a main body including;

a casing, a connector being configured to contact the main body connector in a state where the drum cartridge is attached to the casing, a duct facing the first connecting plate in a state where the drum cartridge is attached to the casing, the duct extending in the first direction, the duct allowing air in the casing to pass therethrough, and a fan being configured to discharge air from the duct, the fan positioned at one end of the duct in the first direction, wherein the connector is positioned at other a second end of the duct in the first direction in a state where the drum cartridge is attached to the casing.

19. The image forming apparatus according to claim 18, wherein the drum cartridge is attachable to the casing of the main body in the second direction.

20. The image forming apparatus according to claim 18, wherein the duct having an intake opening for allowing air to pass therethrough to flow into the duct from the casing, the intake opening having a first intake opening and a second intake opening, the first intake opening positioned closer to one end of the duct in the first direction than the second end of the duct in the first direction, the second intake opening positioned closer to the second end of the duct in the first direction than the one end of the duct in the first direction.

21. The image forming apparatus according to claim 20, wherein the second intake opening is smaller than the first intake opening.

22. The image forming apparatus according to claim 21, wherein the casing includes a first filter for covering the first intake opening and a second filter for covering the second intake opening, the second filter is smaller than the first filter.

23. The image forming apparatus according to claim 22, wherein a dimension of the second filter in a third direction intersecting both of the first direction and the second direction is less than a dimension of the first filter in the third direction.

* * * * *